US008167044B2

(12) United States Patent
Huang et al.

(10) Patent No.: US 8,167,044 B2
(45) Date of Patent: May 1, 2012

(54) SHAPED CHARGE

(75) Inventors: Hongfa Huang, Sugar Land, TX (US); Brenden M. Grove, Missouri City, TX (US); Philip Kneisl, Pearland, TX (US)

(73) Assignee: Sclumberger Technology Corporation, Sugar Land, TX (US)

( * ) Notice: Subject to any disclaimer, the term of this patent is extended or adjusted under 35 U.S.C. 154(b) by 233 days.

(21) Appl. No.: 12/639,384

(22) Filed: Dec. 16, 2009

(65) Prior Publication Data

US 2011/0139505 A1 Jun. 16, 2011

(51) Int. Cl.
*E21B 43/117* (2006.01)
*F42B 1/02* (2006.01)

(52) U.S. Cl. ..... 166/297; 166/63; 102/306; 175/4.6

(58) Field of Classification Search ..... 166/55.1, 166/63, 297, 298, 308.1; 102/307, 306, 476; 175/2, 4.6
See application file for complete search history.

(56) References Cited

U.S. PATENT DOCUMENTS

| | | | | |
|---|---|---|---|---|
| 3,235,005 | A | 2/1966 | Delacour | |
| 5,775,426 | A | 7/1998 | Snider | |
| 6,962,634 | B2 | 11/2005 | Nielson | |
| 7,044,225 | B2 * | 5/2006 | Haney et al. | 166/308.1 |
| 7,278,353 | B2 * | 10/2007 | Langan et al. | 102/306 |
| 7,393,423 | B2 | 7/2008 | Liu | |
| 7,775,279 | B2 * | 8/2010 | Marya et al. | 166/297 |
| 2002/0189482 | A1 * | 12/2002 | Kneisl et al. | 102/306 |
| 2006/0038160 | A1 | 2/2006 | Wood | |
| 2006/0266551 | A1 | 11/2006 | Yang | |
| 2007/0056462 | A1 | 3/2007 | Bates | |
| 2008/0034951 | A1 | 2/2008 | Evans | |
| 2011/0000669 | A1 * | 1/2011 | Barlow et al. | 166/297 |

FOREIGN PATENT DOCUMENTS

| | | |
|---|---|---|
| EP | 1348683 | 10/2003 |
| WO | 2005035939 | 4/2005 |

OTHER PUBLICATIONS

GeoDynamics, Connex Perforating Shaped Charges, Mar. 2009 GeoDynamics, Inc.
GeoDynamics, Connex Perforating ReActiveTM Perforating Technology.
SANDIA Report, SAND95-2448C, Lake Buena Vista, FL, Jul. 1-3, 1996, pp. 1-13.
SANDIA Report, SAND99-1170C, Sydney, Australia, Jul. 12-16, 1999, pp. 1-6.
SANDIA Report, SAND98-1176C, Monterey, CA, Jul. 1998.
23rd International Symposium on Ballistics; vol. 1; 239-246 (2007). SPE #381.

* cited by examiner

*Primary Examiner* — Daniel P Stephenson
(74) *Attorney, Agent, or Firm* — Chadwick A. Sullivan

(57) ABSTRACT

A perforating apparatus that is usable with a well includes a shaped charge. The shaped charge includes a case, an explosive and a liner. The liner is adapted to form a perforation jet to form a perforation tunnel and promote an exothermic reaction inside the tunnel to create a pressure wave to force debris from the tunnel.

17 Claims, 4 Drawing Sheets

FIG. 6

250

| # | REACTANTS |
|---|---|
| 1 | $2Al + Bi_2O_3$ |
| 2 | $2Al + 3CuO$ |
| 3 | $2Al + Fe_2O_3$ |
| 4 | $8Al + Fe_3O_4$ |
| 5 | $2Al + 3NiO$ |
| 6 | $4Al + PbO_2$ |
| 7 | $2Al + PdO$ |
| 8 | $4Al + 3SnO_2$ |
| 9 | $4Al + 3WO_2$ |
| 10 | $2Al + WO_3$ |
| 11 | $Be + CuO$ |
| 12 | $3Be + Fe_2O_3$ |
| 13 | $4Be + Fe_3O_4$ |
| 14 | $2Be + PbO_2$ |
| 15 | $2Ti + Pb_3O_4$ |
| 16 | $3Zr + 2Fe_2O_3$ |
| 17 | $2Zr + Fe_3O_4$ |
| 18 | $Zr + MnO_2$ |
| 19 | $2Zr + Pb_3O_4$ |

FIG. 7

280

| # | COMPOUNDS |
|---|---|
| 1 | $Ba(NO_3)_2$ |
| 2 | $Sr(NO_3)_2$ |
| 3 | $Ca(NO_3)_2$ |
| 4 | $LiNO_3$ |
| 5 | $BaCO_3$ |
| 6 | $SrCO_3$ |
| 7 | $CaCO_3$ |

SHAPED CHARGE

BACKGROUND

The invention generally relates to a shaped charge and more particularly relates to a shaped charge having a liner that promotes an exothermic reaction inside a perforation tunnel to force debris from the tunnel.

For purposes of producing well fluid (oil or gas) from a hydrocarbon bearing formation, the formation typically is perforated from within a wellbore to enhance fluid communication between the reservoir and the wellbore. A typical perforating operation involves running a perforating gun into the wellbore (on a string, for example) to the region of the formation to be perforated. The perforating gun typically includes shaped charges, which are radially directed outwardly toward the region of the formation rock to be perforated. In this manner, the shaped charges are fired to produce corresponding perforating jets that pierce the well casing (if the wellbore is cased) and form corresponding perforation tunnels in the surrounding formation rock.

After the perforating operation, the perforation tunnels typically contain debris attributable to formation rock as well powder left behind by the perforating jets. This debris obstructs the perforation tunnels and may degrade the overall permeability of the formation if not removed.

SUMMARY

In an embodiment of the invention, a perforating apparatus that is usable with a well includes a shaped charge. The shaped charge includes a case, an explosive and a liner. The liner is adapted to form a perforating jet to form a perforation tunnel and promote an exothermic reaction inside the tunnel to create a pressure wave to force debris from the tunnel.

In another embodiment of the invention, a perforating apparatus that is usable with a well includes a shaped charge. The shaped charge includes a case, an explosive and a liner that includes thermite.

In yet another embodiment of the invention, a technique that is usable with a well includes generating a perforating jet to form a perforation tunnel and including a material in the perforating jet to promote an exothermic reaction inside the tunnel to create a pressure wave to force debris from the tunnel.

Advantages and other features of the invention will become apparent from the following drawing, description and claims.

BRIEF DESCRIPTION OF THE DRAWING

FIG. 6 is a table illustrating thermite compounds that may be included in a liner of the shaped charge according to different examples.

FIG. 7 is a table illustrating metal nitrate and metal carbonate compounds that may be included in a liner of the shaped charge according to different examples.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Techniques and systems are disclosed herein, which use a shaped charge-generated perforating jet to both create a perforation tunnel in formation rock and clean out debris from the perforation tunnel. More specifically, as described herein, the shaped charge has a generally conical liner that, when an explosive of the shaped charge is detonated, collapses to form a perforating jet that creates a perforation tunnel in the formation rock. The liner contains an energetic material that causes an exothermic reaction to occur inside the perforation tunnel, and this exothermic reaction, in turn, generates a pressure wave that forces debris out of the tunnel. The rapid rise in temperature due to the exothermic reaction may have other beneficial effects, such as inducing thermal stress-related cracks in the formation rock, which may lower the required fracture initiation pressure in a subsequent fracturing operation.

Figure 1:
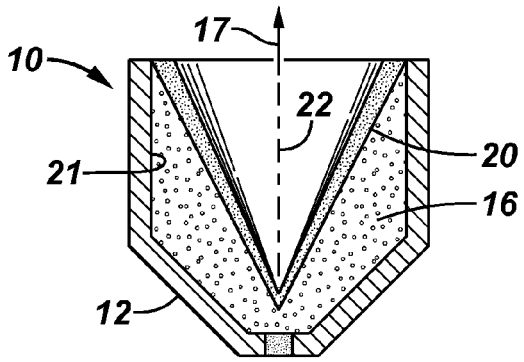
FIG. 1 is a cross-sectional view of a shaped charge according to an example.

Turning to a more specific example, a shaped charge 10 (see FIG. 1) in accordance with an example includes a cup-shaped, shaped charge case 12, which includes a recessed region 21 for receiving an explosive 16 (HMX, as a non-limiting example) and a liner 20. As depicted in FIG. 1, the liner 20 may be generally conical, may be symmetrical about a perforating axis 22, and may have a thickness that varies along the axis 22.

Upon detonation of the explosive 16 (caused by a detonation wave that propagates along a detonating cord (not shown in FIG. 1) that is in proximity to the explosive), the liner 20 collapses about the axis 22 and forms a perforating jet that propagates in an outgoing direction 17 along the axis 22 into the surrounding formation rock to form a corresponding perforation tunnel. It is noted that although the shaped charge 10 is depicted in FIG. 1 as not being capped, as can be appreciated by the skilled artisan, the shaped charge 10 may or may not include a charge cap, depending on the particular implementation.

In accordance with a more specific example, the energetic material of the liner 20 may be a thermite-based compound (also called "thermite" herein). In this manner, the liner 20 may be formed from conventional metal powders, which are combined (via a binder, for example) with a thermite compound. In other arrangements, the liner 20 may be formed entirely from a thermite compound. Furthermore, as described below, the liner 20 may include a thermite compound and a gas-forming compound that promotes the formation of a pressure wave inside the perforation tunnel.

As examples of yet other variations, the liner 20 may include an energetic material other than thermite for purposes of promoting an exothermic reaction inside the perforation tunnel, and the liner 20 may include a combination of different energetic materials. Thus, many variations and compositions of the liner 20 are contemplated and are within the scope of the appended claims.

Figure 2:
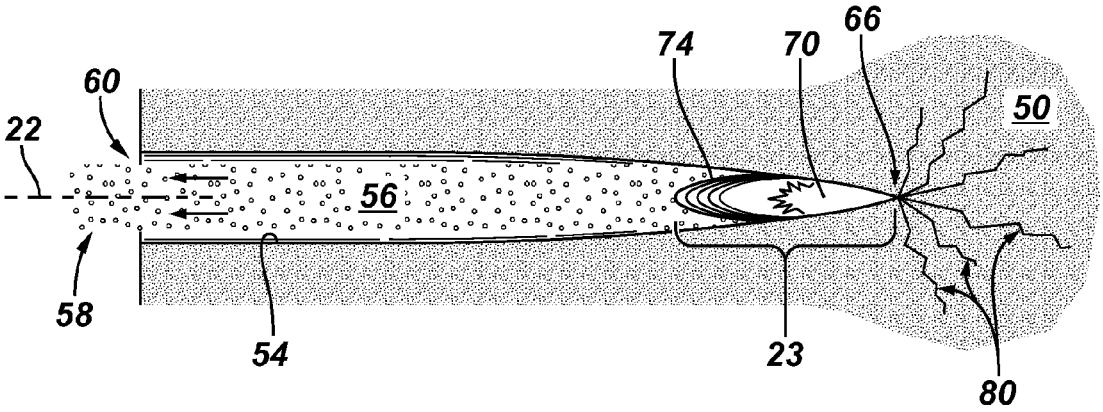
FIG. 2 is a cross-sectional view of a section of a formation illustrating creation of a pressure wave inside a perforation tunnel according to an example.

Referring to FIG. 2 in conjunction with FIG. 1, FIG. 2 illustrates an intermediate state in the perforating operation in which a perforation tunnel 54 has been formed in formation rock 50 from a higher velocity leading portion of the perforating jet 23, and debris 56 exists in the perforation tunnel 54. The debris 56 may be attributable to, for example, powder from the perforating jet 23, as well as rock debris that is created by the formation of the tunnel 54. In the state that is depicted in FIG. 2, energetic material (such as thermite, for example) from the liner 20 forms a relatively slower portion of the perforating jet 23 behind the jet's leading portion and ignites (as shown at reference numeral 70) due to the impact of the energetic material with the formation rock 50 at a closed end 66 of the perforation tunnel 54. More specifically, due to the impact, the energetic material exothermically reacts, which produces a relatively high pressure wave 74 that propagates along the axis 22 in a direction that is opposite to the direction along which the perforating jet 23 propagates to form the perforation tunnel 54.

The pressure wave 74 thus travels from a location near the closed end 66 (where the wave 74 originates) through the perforation tunnel 64 and exits the tunnel 54 at the tunnel entrance 60. The pressure wave 74 expels the debris 56 from the tunnel 54, as illustrated by the exiting debris 58 at the tunnel entrance 60 for the intermediate state that is depicted in FIG. 2. As also illustrated in FIG. 2, the relatively high thermal stress that is created by the exothermic reaction of the energetic material may cause relatively fine cracks 80 to form at the closed end 66 of the perforation tunnel 54. These fine cracks may be particularly advantageous for a subsequent fracturing operation in that the cracks may reduce the fracture initiation pressure that is otherwise required in the fracturing operation.

Figure 3:
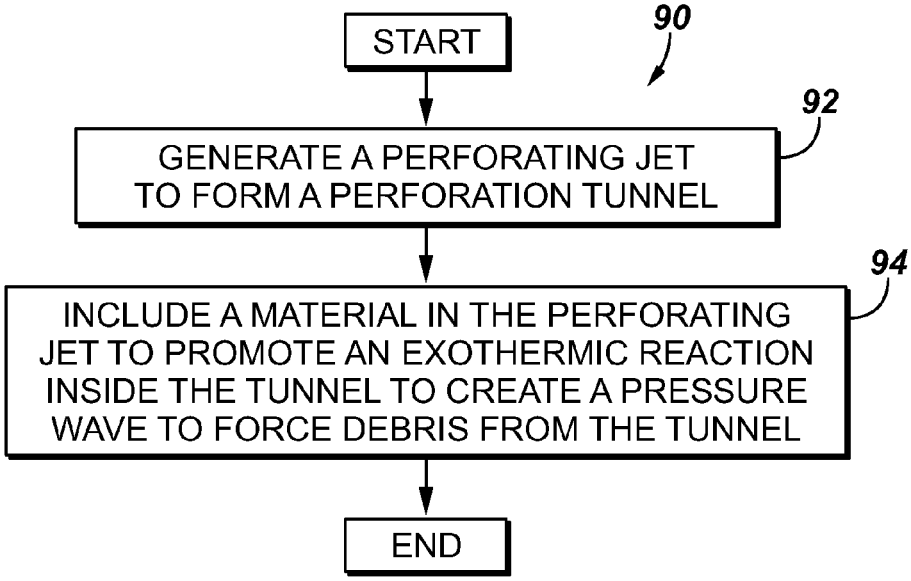
FIG. 3 is a flow diagram depicting a technique to remove debris from a perforation tunnel according to an example.

Referring to FIG. 3, to summarize, a technique 90 to perforate a formation includes generating (block 92) a perforating jet to form a perforation tunnel and including (block 94) a material in the perforating jet to promote an exothermic reaction inside the tunnel to create a pressure wave to force debris from the tunnel.

To summarize some of the possible advantages of using the shaped charge 10, the shaped charge 10 cleans out the perforation tunnel to remove rock and powder debris from the tunnel, thereby increasing permeability of the perforated formation. Moreover, the shaped charge 10 may create cracks in the formation rock, which is beneficial for a subsequent fracturing operation. Additionally, the pressure wave may be able to remove part of the damaged tunnel skin, which further enhances the permeability of the formation.

For the case in which the liner's energetic material is a thermite compound, the compound may be one of the thermite compounds, which are depicted in a table 250 in FIG. 6. Other thermite compounds may be used, in accordance with other examples. Furthermore, depending on the particular example, the liner 20 may include a mixture of one or more of the thermite compounds listed in the table 250, as yet another variation. Thus, many variations are contemplated and are within the scope of the appended claims.

As described above, the above-described exothermic reaction inside the tunnel produces a debris-clearing pressure wave. The pressure wave may be a gas wave, and the source of the gas, in accordance with one example, may be a pre-existing hydrocarbon and/or water inside the formation rock. In this regard, the exothermic reaction inside the perforation tunnel gasifies and expands the hydrocarbon and/or water under extreme high temperature after the thermite reaction to produce the pressure wave.

Alternatively, the gas for the pressure wave may solely or partially be due to the product of a reaction caused by a gas producing compound of the liner 20 (see FIG. 1). In this regard, the liner 20 (see FIG. 1) may, in addition to the thermite material or other energetic material, include a gas-producing compound that is built into the liner 20 for purposes of producing gas to form the pressure wave. Although the gas-producing compound may have a relatively high stable temperature, the heat that is produced by the exothermic reaction inside the tunnel is sufficiently high to promote a reaction that converts the gas-producing compound (that travels into the tunnel as part of the perforating jet 23 (FIG. 2)) into a gas.

As a non-limiting example, the gas producing compound may be a metal nitrate, such as barium nitrate ($Ba(NO_3)_2$) or strontium nitrate ($Sr(NO_3)_2$). As another non-limiting example, the gas producing compound may be a metal carbonate, such as calcium carbonate ($CaCO_3$). Examples of metal nitrates and metal carbonates that may be included in the liner for purposes of producing gas inside the perforating tunnel are listed in a table 280 in FIG. 7. Other metal nitrate and metal carbonate compounds may be used in other implementations, as well as compounds other than metal nitrate and metal carbonate compounds.

Figure 4:
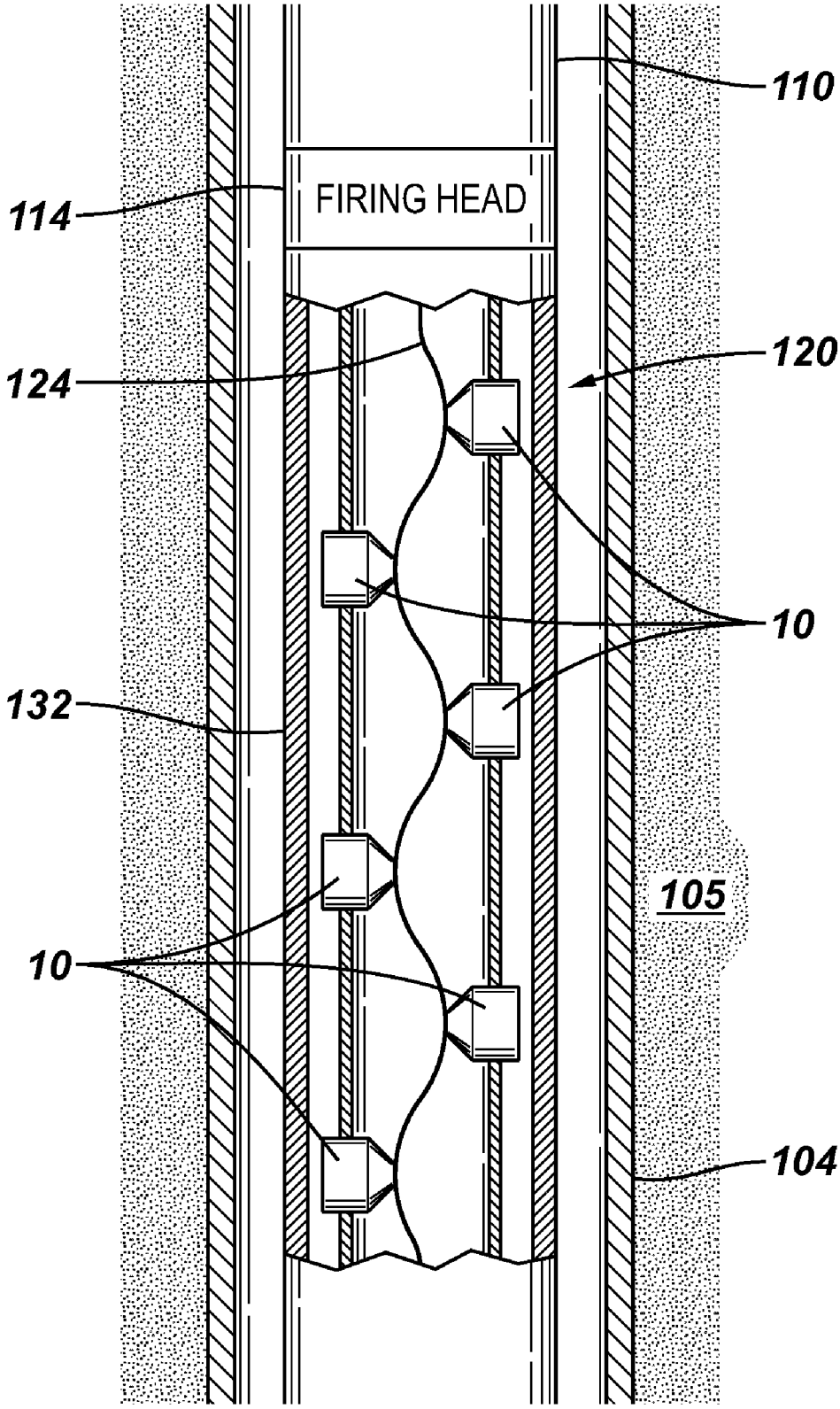
FIG. 4 is a schematic diagram of a perforating gun according to an example.

The shaped charge 10 may be incorporated into various downhole tools, depending on the particular application. For example, referring to FIG. 4, multiple shaped charges 10 may be incorporated into a perforating gun 120. As shown in FIG. 4, the perforating gun 120 may extend into a wellbore as part of a tubular string 110 for this example. The perforating gun 120 includes a tubular carrier 132, which houses the shaped charges 10. As an example, the shaped charges 10 may be attached to the interior surface of the carrier 132 using, for example, charge caps of the shaped charges 10. As also depicted in FIG. 4, the perforating gun 120 may include a detonating cord 124 communicates a detonation wave (which propagates from a firing head 114 or other perforating gun, as non-limiting examples) for purposes of firing the shaped charges 10.

When fired, each shaped charge 10 produces a corresponding radially-directed perforating jet that penetrates the surrounding casing 104 (if the wellbore is cased as shown in FIG. 4), forms a perforation tunnel in surrounding formation rock 105 and clears debris from the tunnel, as described above.

It is noted that the perforating gun 120 is illustrated as a general example, as many other variations and uses of the shaped charges 10 are contemplated, as can be appreciated by the skilled artisan. For example, the perforating gun 120 may be a strip-based perforating gun that does not include a carrier, may include capped or capless shaped charges, may including shaped charges that are spirally phased, may include shaped charges that are phased in planes, etc., depending on the particular implementation. Regardless of its particular design, the perforating gun 120 includes at least one shaped charge that has a liner to form a perforation tunnel and promote an exothermic reaction inside the perforation tunnel to create a pressure wave to force debris from the tunnel. Furthermore, as discussed above, in addition to containing an energetic material, the liner may contain one or more other compounds, such as a gas producing compound, an inert compound, etc., depending on the particular implementation.

Figure 5:
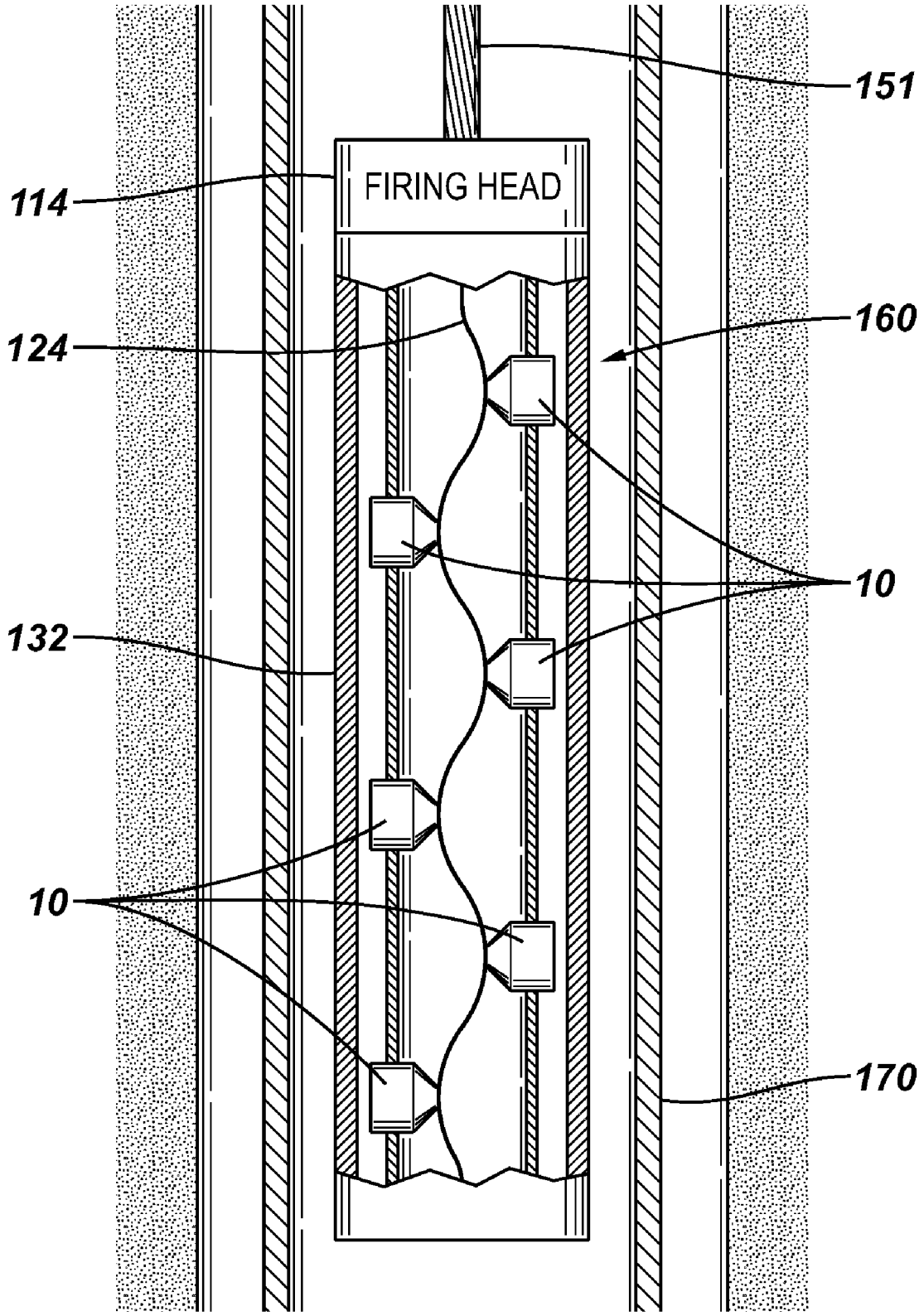
FIG. 5 is a schematic diagram of a tubing puncher according to an example.

The shaped charge 10 may be used in applications other than applications that primarily are directed to forming perforation tunnels. For example, FIG. 5 depicts a tubing puncher 160, which includes multiple shaped charges 10 in accordance with another example. The tubing puncher 160 may be conveyed downhole on a slickline or wireline 151 inside a tubing 170 (a coiled tubing or jointed tubing, as non-limited examples), depending on the particular implementation. The tubing puncher 160 has the same general design as the perforating gun 120 (FIG. 4), with like reference numerals being used to denote similar components. The tubing puncher 160 forms perforating jets to form corresponding holes, or openings, in the surrounding tubing 170. Thus, many applications and uses of the shaped charges disclosed herein are contemplated and are within the scope of the appended claims, including applications and uses that are not specifically described above.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A perforating apparatus usable with a well, comprising:
a shaped charge;
a case of the shaped charge;
an explosive of the shaped charge disposed within the case;
a liner of the shaped charge engaged against the explosive configured to provide a perforating jet upon detonation of the explosive and to form a perforation tunnel;
an energetic material component of the liner configured to promote an exothermic reaction thereof inside the perforation tunnel after detonation of the explosive; and
a gas producing component of the liner configured to react in the presence of the exothermic reaction of the energetic material component to create gas and thereby a pressure wave which travels back through the tunnel to force debris from the tunnel.

2. The apparatus of claim 1, wherein the energetic material component comprises thermite.

3. The apparatus of claim 1, wherein the energetic material component is selected so that the exothermic reaction forms a formation rock crack near an end of the perforation tunnel.

4. The apparatus of claim 1, wherein the energetic material component comprises thermite and the gas producing component comprises a metal nitrate or a metal carbonate.

5. The apparatus of claim 1, wherein the gas producing component comprises strontium nitrate.

6. The apparatus of claim 1, wherein the energetic material component is selected so that the exothermic reaction heats water or a hydrocarbon inside the perforation tunnel so as to produce an expanding gas to generate the pressure wave.

7. The apparatus of claim 1, further comprising:
at least one additional shaped charge, each additional shaped charge comprising another case, another explosive and another liner, said another liner being adapted to, in response to form another perforating jet to form another perforation tunnel and promote an exothermic reaction inside said another perforation tunnel to create a pressure wave to force debris from said another perforation tunnel.

8. The apparatus of claim 7, further comprising a perforating gun that houses the shaped charges.

9. The apparatus of claim 1, wherein the gas producing component is selected from the group consisting of barium nitrate, strontium nitrate, calcium nitrate, lithium nitrate, barium carbonate, strontium carbonate and calcium carbonate.

10. A perforating apparatus usable with a well, comprising:
a shaped charge;
a case of the shaped charge;
an explosive of the shaped charge disposed within the case;
a liner of the shaped charge engaged against the explosive configured to provide a perforating jet upon detonation of the explosive and to form a perforation tunnel;
a thermite component of the liner configured to promote an exothermic reaction thereof inside the perforation tunnel after detonation of the explosive; and
a gas producing component of the liner configured to react in the presence of the exothermic reaction of the thermite component to create gas and thereby a pressure wave which travels back through the tunnel to force debris from the tunnel,
wherein the gas producing component includes at least one of a metal carbonate and a metal nitrate.

11. The apparatus of claim 10, wherein the gas producing component is selected from the group consisting of barium nitrate, strontium nitrate, calcium nitrate, lithium nitrate, barium carbonate, strontium carbonate and calcium carbonate.

12. The apparatus of claim 10, wherein the gas producing component comprises strontium nitrate.

13. The apparatus of claim 10, further comprising a perforating gun that houses the shaped charge.

14. The apparatus of claim 10, further comprising a metal tubing puncher that houses the shaped charge.

15. A method usable with a well, comprising:
generating a perforating jet to form a perforation tunnel by detonating an explosive of a shaped charge so that a liner of the shaped charge is propelled away from the shaped charge through a wall of a wellbore;
heating the liner and fluid therearound by an exothermic reaction of a thermite component of the liner initiated by the detonation of the explosive of the shaped charge;
reacting a gas producing component of the liner as a result of the heat produced by the exothermic reaction of the thermite component to create gas within the perforation tunnel; and
providing a pressure wave of the gas created by the reaction of the gas producing component which travels through the perforation back to the wellbore to force debris from the perforation tunnel.

16. The method of claim 15, wherein the exothermic reaction of the thermite component reacts with water or a hydrocarbon present in the perforation tunnel to provide additional gas within the perforation tunnel.

17. The method of claim 15, wherein the gas producing component is selected from the group consisting of barium nitrate, strontium nitrate, calcium nitrate, lithium nitrate, barium carbonate, strontium carbonate and calcium carbonate.

* * * * *